US007658654B2

(12) United States Patent
Ohyama et al.

(10) Patent No.: US 7,658,654 B2
(45) Date of Patent: Feb. 9, 2010

(54) FEMALE TERMINAL FITTING

(75) Inventors: Kouichi Ohyama, Makinohara (JP); Shinobu Suzuki, Makinohara (JP); Masakuni Samejima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/272,459

(22) Filed: Nov. 17, 2008

(65) Prior Publication Data

US 2009/0149087 A1 Jun. 11, 2009

(30) Foreign Application Priority Data

Dec. 5, 2007 (JP) ..... 2007-314247

(51) Int. Cl.
*H01R 13/514* (2006.01)

(52) U.S. Cl. ..... 439/752; 439/844

(58) Field of Classification Search ..... 439/78, 439/83, 752, 844

See application file for complete search history.

(56) References Cited

U.S. PATENT DOCUMENTS 5,713,745 A * 2/1998 Sakurai et al. ..... 439/78
6,244,909 B1 * 6/2001 Okada et al. ..... 439/844
6,609,922 B2 * 8/2003 Torii ..... 439/247

FOREIGN PATENT DOCUMENTS

| | | | |
|---|---|---|---|
| JP | 61-77281 | A | 4/1986 |
| JP | 3-11566 | A | 1/1991 |
| JP | 08-203591 | A | 8/1996 |
| JP | 10-172638 | A | 6/1998 |
| JP | 2007-141671 | A | 6/2007 |

* cited by examiner

*Primary Examiner*—Thanh-Tam T Le
(74) *Attorney, Agent, or Firm*—Sughrue Mion, PLLC

(57) ABSTRACT

A female terminal fitting includes a bottom plate which extends in a front-back direction, a female electrical contact portion formed on a front side of the bottom plate, a board connecting portion extending backward of the bottom plate, and a stress relaxation portion. The bottom plate has a first stress relaxation portion which is resiliently deformable in an up-down direction. A side wall is erected from and formed on at least one side portion of the bottom plate in a right-left direction. A connecting portion connects to the board connecting portion in a state that the board connecting portion is arranged so as to be parallel to the front-back direction and is located more inside than the side wall. The connecting portion is a second stress relaxation portion which is resiliently deformable in the right-left direction and in the front-back direction.

6 Claims, 7 Drawing Sheets

FEMALE TERMINAL FITTING

BACKGROUND

The present invention relates to a female terminal fitting for a board having a stress relaxation portion.

Referring to FIG. 7A, in a female terminal fitting 101 disclosed in JP-A-3-11566, a box-shaped female electrical contact portion 103 is formed on the front side of a bottom plate 102. Further, a fixed portion 104 is formed on the rear side of the bottom plate 102. A U-shaped supporting portion 105 which rises from both right and left sides is formed at a rear end of the bottom plate 102. An upper plate 107 is formed continuously with a pair of connecting pieces 106 which become both side walls of the supporting portion 105. A fixing flexible plate 108 is continuously formed toward the female electrical contact portion 103 from the plate 107. The fixing flexible plate 108 is formed so as to face a rear portion 109 of the bottom plate 102. A locking hole 110 is formed in the fixing flexible plate 108. A curved resilient piece 111 which is folded back in a U-shape is formed continuously with the portion of the fixing flexible plate 108 on the side of the female electrical contact portion 103. A slanting engagement and guide portion 112, a part 113 continuous with the slanting engagement and guide portion 112, and a slanting resilient 114 are formed in the curved resilient piece 111. A protruding portion 115 for soldering is formed continuously with the slanting resilient portion 114.

Referring to FIG. 7B, a connector housing 116 has a terminal receiving chamber 117 which receives the female terminal fitting 101. The terminal receiving chamber 117 is formed such that a male terminal insertion hole 118 is located on the left of the drawing, and a female terminal fitting insertion hole 119 is located on the right of the drawing. A locking projection 120 which is hooked to the locking hole 110 of the female terminal fitting 101 is formed in the terminal receiving chamber 117.

In the above configuration, when the female terminal fitting 101 is inserted into the terminal receiving chamber 117 via the female terminal fitting insertion hole 119, the front face of the female electrical contact portion 103 of the female terminal fitting 101 abuts on the inner surface of the male terminal fitting insertion hole 118, and the locking hole 110 of the female terminal fitting 101 is locked by the locking projection 120. Thereby, assembling of the connector 121 is completed. Thereafter, when the protruding portion 115 for soldering of the female terminal fitting 101 is inserted into a printed wiring board 122, and soldering 123 is then performed, the connector 121 is fixed to printed wiring board 122, which allows connection with a mating connector.

Even if an axial positional deviation is caused between the connector 121 and the male terminal fitting of the mating connector, the curved resilient piece 111 of the female terminal fitting 101 is adapted to be able to resiliently deform in an up-down direction or a right-left direction (in the direction of the central axis of the female terminal fitting 101) of the FIG. 7B, and thereby to absorb the positional deviation (the female terminal fitting 101 has a structure which hardly deforms in a direction perpendicular to the sheet plane of FIG. 7B). The curved resilient piece 111 is formed so as to function as a stress relaxation portion in the female terminal fitting 101.

Meanwhile, the above conventional female terminal fitting 101 has a structure which hardly deforms in a direction perpendicular to the sheet plane of FIG. 7B. Therefore, if the male terminal fitting of the mating connector haven been obliquely inserted, a contact portion (spring portion 124) of the female terminal fitting 101 is excessively bent by the male terminal fitting. This bending causes permanent deformation. As a result, there is a problem in that stable contact cannot be secured. Further, on the side of the connector 121, there is also a problem in that the female terminal fitting 101 may be curved and deformed by the movement of the mating connector.

In addition, in the above conventional female terminal fitting 101, there is also a problem in which, even if dimensional control by image processing is attempted in order control the gap between the inner surface of the female electrical contact portion 103, and the spring portion 124, this control cannot be executed. This is because, even if a camera 125 is set in front of the female electrical contact portion 103, a light source 126 is set behind the protruding portion 115 for soldering, and then light 127 is emitted forward from the light source 126, the light 127 may be shielded by the curved resilient piece 111, and the light 127 does not reach the gap between the inner surface of the female electrical contact portion 103, and the spring portion 124, and consequently, photographing by the camera 125 cannot be performed. Due to such a problem, it becomes impossible to perform high-precision dimensional control. As a result, the reliability related to electrical contact may be degraded.

Since the above conventional connector housing 116 has the locking projection 120 which is hooked to the locking hole 110 of the female terminal fitting 101, there is a problem in that the die structure for portions of the terminal receiving chambers 117 may become complicated.

SUMMARY

The invention has been made in view of the above situation, and the object of the invention is to provide a female terminal fitting capable of sufficiently enhancing contact stability, and executing high-precision dimensional control over the contact portion to be contacted by a male terminal fitting. Further, another object of the invention is to provide a female terminal fitting capable of simplifying the die structure for the portion of a terminal receiving chamber.

In order to achieve the above object, according to the present invention, there is provided a female terminal fitting, comprising:

a bottom plate formed in a flat shape and which extends in a front-back direction;

a female electrical contact portion formed on a front side of the bottom plate to contact a mating male terminal fitting;

a board connecting portion extending backward of the bottom plate for connecting to a circuit board; and a stress relaxation portion formed between the electrical contact portion and the board connecting portion, wherein the bottom plate has a first stress relaxation portion which is resiliently deformable in an up-down direction being perpendicular to the front-back direction;

wherein a side wall is erected from and formed on at least one side portion of the bottom plate in a right-left direction being perpendicular to the both of the up-down direction and the front-back direction;

wherein a belt-like connecting portion is formed on a rear end of the side wall, and connects to the board connecting portion in a state that the board connecting portion arranged so as to be parallel to the front-back direction and is located more inside than the side wall; and wherein the connecting portion is a second stress relaxation portion which is resiliently deformable in the right-left direction and in the front-back direction.

According to the above configuration, even if there is oblique insertion of a male terminal fitting of a mating connector, the force exerted by the oblique insertion is absorbed by the resilient deformation of the first stress relaxation portion and the second stress relaxation portion. Accordingly, it becomes possible to improve the contact stability between a contacting portion of the female terminal fitting for a board and the male terminal fitting.

Also, the effect that contact stability can be sufficiently enhanced is exhibited. Further, according to the invention, the effect that high-precision dimension control over a contacting portion that a male terminal fitting contacts is exhibited.

Further, according to the invention, since a structure in which a portion which shields light does not exists behind the female electrical contact portion is obtained, it becomes possible to execute the dimensional control by image processing.

Preferably, the side wall has an abutting convex portion which regulates a backward movement of the female terminal fitting.

According to the above configuration, for example, even if the female terminal fitting for a board is pushed backward by the movement of the mating connector, the convex portion abuts on the rear wall of a terminal receiving chamber which receives the female terminal fitting for a board of the invention. Accordingly, backward movement of the female terminal fitting for a board is regulated, and the second stress relaxation portion is not resiliently deformed excessively. Further, when backward movement is regulated, stress is not concentrated on a portion connected with a board. Thus, contact stability is kept well.

Further, according to the invention, it is not necessary to form a locking projection for locking a terminal fitting in the terminal receiving chamber, and the structure of the female terminal fitting becomes good simply by forming a wall which makes the abutting convex portion abut on the rear portion of the terminal receiving chamber. Thus, it is possible to simplify the die structure for the portion of the terminal receiving chamber.

Also, for example, even if the female terminal fitting for a board is pushed backward by the movement of the mating connector, the effect that contact stability can be kept well is exhibited. Further, according to the invention, the effect that the die structure for the portion of the terminal receiving chamber can be simplified is exhibited.

Preferably, the first stress relaxation portion is a part of the bottom plate which has no side wall at both side portions of the bottom plate.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 3A and 3B are schematic views showing a state where the force exerted by the oblique insertion is absorbed by an elastic deformation in a right-left direction and, and FIGS. 3C and 3D are schematic views showing a state where the force exerted the oblique insertion is absorbed by an elastic deformation in an up-down direction;

DETAILED DESCRIPTION OF EXEMPLARY EMBODIMENTS

Figure 1A:
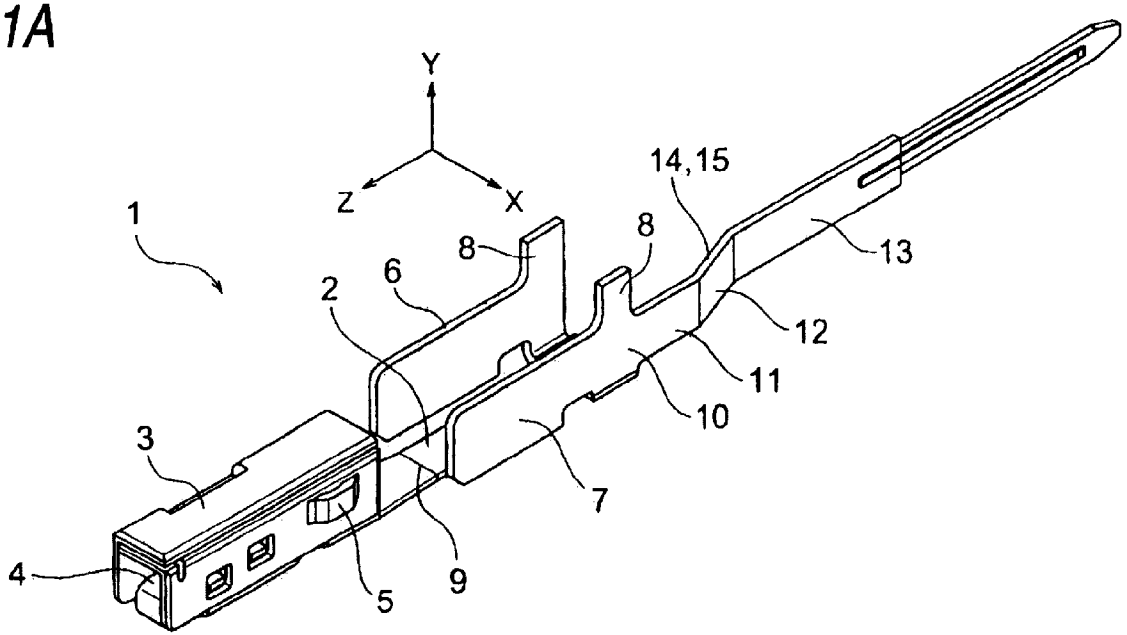
FIG. 1A is a perspective view of a female terminal fitting for a board according to one embodiment of the invention.
Figure 1B:
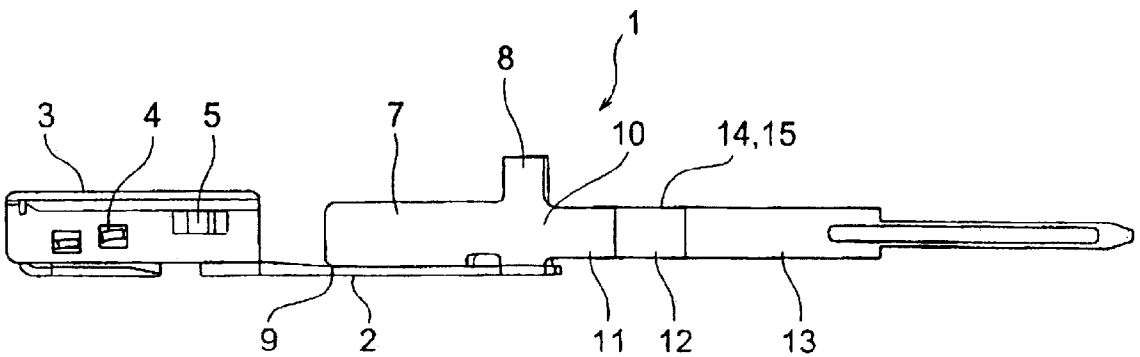
FIG. 1B is a side view of the female terminal fitting for the board.
Figure 2A:
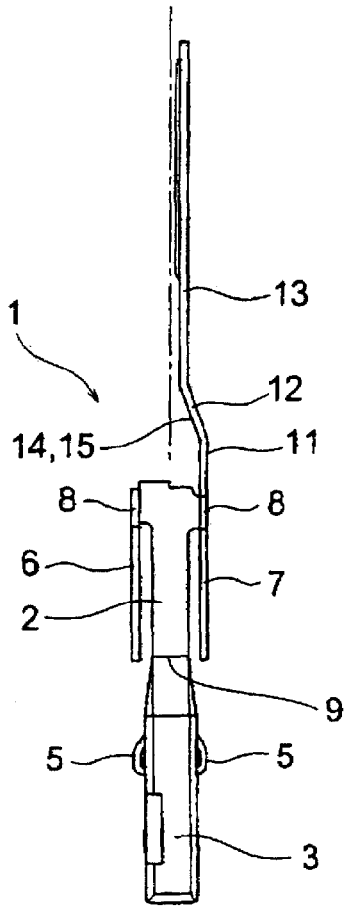
FIG. 2A is a plan view of the female terminal fitting for the board.
Figure 2B:
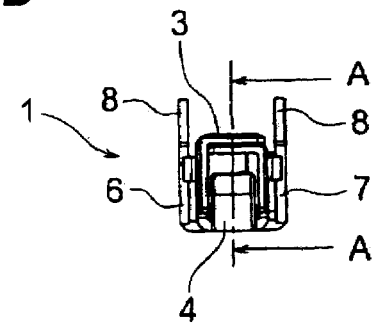
FIG. 2B is a front view of the female terminal fitting for the board.
Figure 2C:
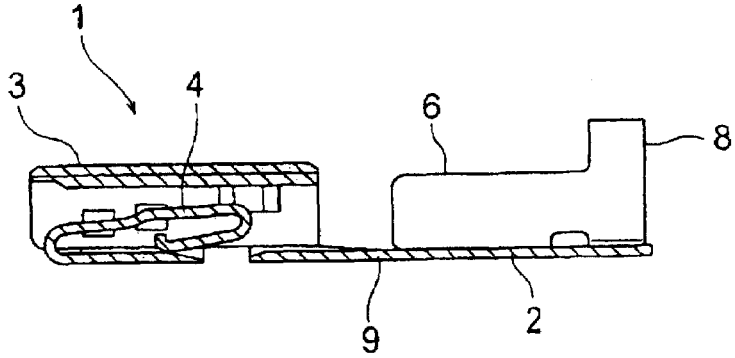
FIG. 2C is a sectional view taken along a line A-A of FIG. 2B.

Hereinafter, description will be provided with reference to the drawings. FIGS. 1A and 1B are views showing a female terminal fitting for a board according to one embodiment of the invention. FIG. 1A is a perspective view of the female terminal fitting for the board, and FIG. 1B is a side view of the female terminal fitting for the board. Further, FIG. 2A is a plan view of the female terminal fitting for a board, and FIG. 2B is a front view of the female terminal fitting for a board, and FIG. 2C is a sectional view taken along a line A-A of FIG. 2B.

Figure 3A:
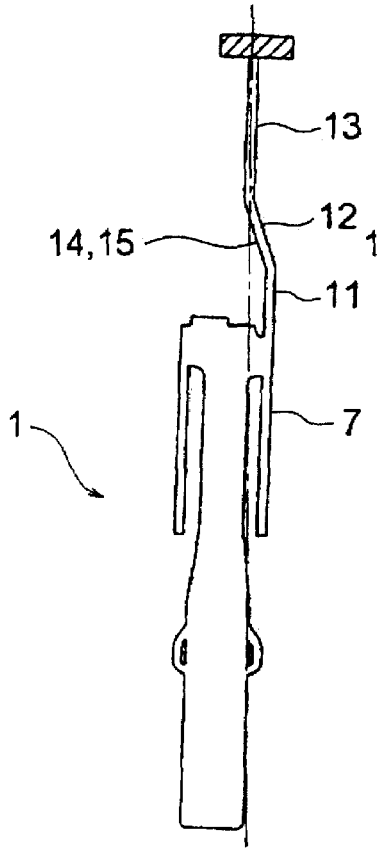
FIGS. 3A to 3C are views showing stress relaxation states of the female terminal fitting for the board when a mating male terminal fitting is obliquely inserted.
Figure 3B:
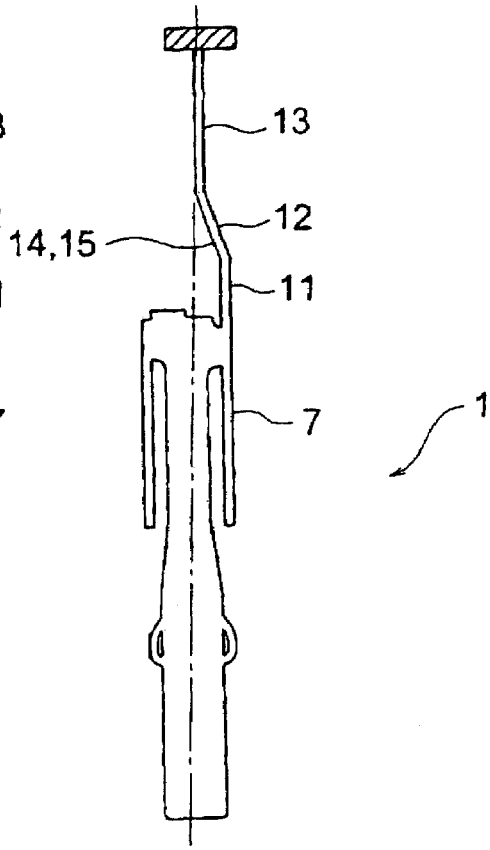
Figure 3C:
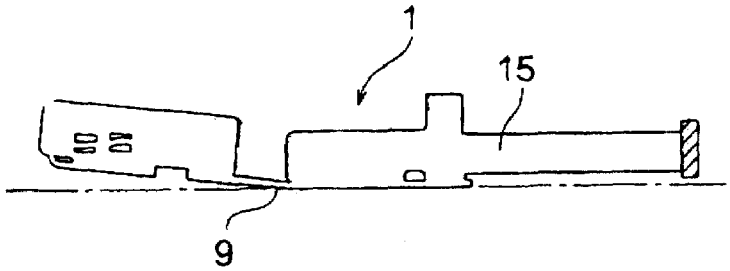
Figure 3D:
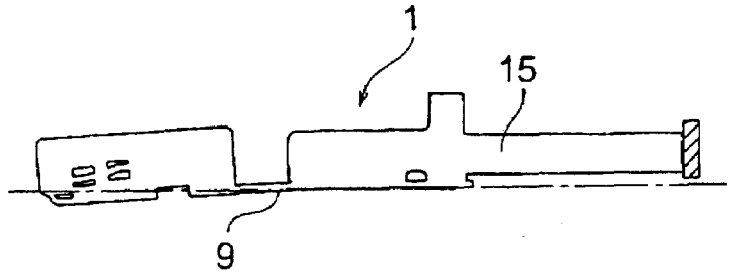
Figure 4:
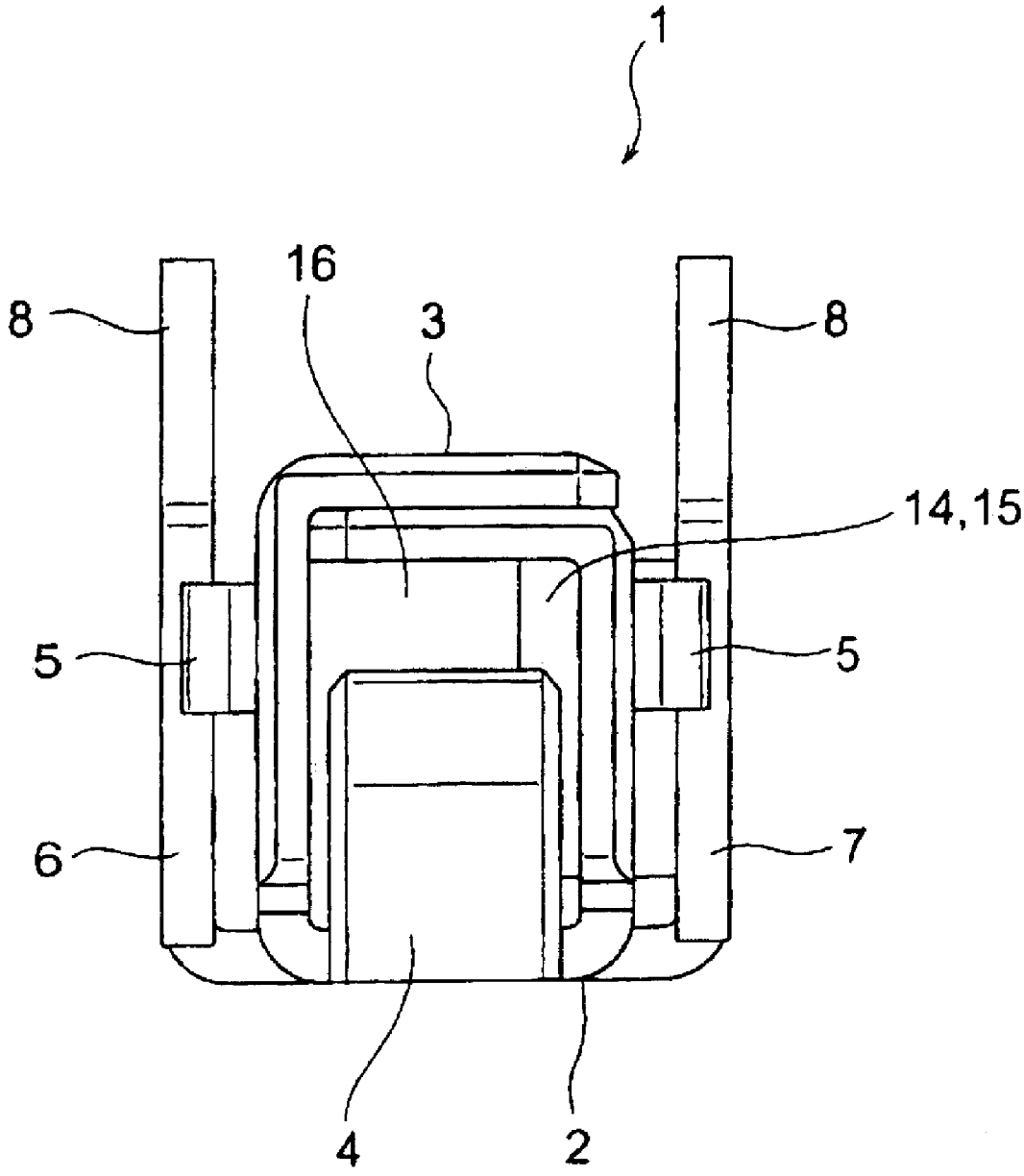
FIG. 4 is an enlarged front view of the female terminal fitting for a board.

Moreover, FIGS. 3A to 3C are views showing stress relaxation states of the female terminal fitting for the board when a mating terminal is obliquely inserted. FIGS. 3A and 3B are schematic views showing a state where the force exerted by the oblique insertion is absorbed by an elastic deformation in a right-left direction and, and FIGS. 3C and 3D are schematic views showing a state where the force exerted the oblique insertion is absorbed by an elastic deformation in an up-down direction. Furthermore, FIG. 4 is an enlarged front view of the female terminal fitting for a board.

In addition, in the following description, an arrow X in FIG. 1A is defined as a right-left direction, an arrow Y is defined as an up-down direction, and an arrow Z is defined as a front-back direction (axial direction of the terminal).

In FIGS. 1A and 1B, and FIGS. 2A to 2D, reference numeral 1 represents a female terminal fitting for a board. The female terminal fitting 1 for a board is fabricated by punching one metal plate having conductivity into a predetermined shape, and thereafter bending the bent metal plate into a shape as shown.

The female terminal fitting 1 for a board have a bottom plate 2 which is formed in a flat belt-like shape, and formed so as to extend in the front-back direction. On the front side of the bottom plate 2, a female electrical contact portion 3 which contacts the mating male terminal fitting (not shown) is formed. The female electrical contact portion 3 is formed in a box shape and in a tubular shape. Further, the female electrical contact portion 3 is formed so as to be opened in a rectangular shape in the front-back direction. The female electrical contact portion 3 is formed so that the mating male terminal fitting can be inserted thereinto.

A spring portion (resilient contact piece) 4 which resiliently contacts the mating male terminal fitting is formed inside the female electrical contact portion 3. Further, guide projections 5 which project outward by cutting and raising are formed at both right and left sides of the female electrical contact portion 3. The guide projections 5 are formed to function as guide portions when being received in a terminal receiving portion to be mentioned later.

At both the right and left sides of the bottom plate 2, side walls 6 and 7 are arranged and formed. Both the side walls 6 and 7 are formed so as to be connected only in rear end positions of both the right and left sides. The side walls 6 and 7 are formed so as to extend toward the female electrical contact portion 3. The side walls 6 and 7 are belt-like, and are formed so as to have surfaces in the direction orthogonal to the bottom plate 2. Abutting convex portions 8 are formed opposite to the portions of the side walls 6 and 7 which are formed continuously with the bottom plate 2. The abutting convex portions 8 are formed so as to be rectangular convex portions. The abutting convex portions 8 will be described below.

A portion of the belt-like bottom plate 2 is existed between a portion connected with the side wall 6 and 7, and the female electrical contact portion 3. The portion of the belt-like bottom plate 2 is not connected with others, but exists independently. This portion of the belt-like bottom plate 2 which is deformable in the up-down direction is formed as a first stress relaxation portion 9 adapting to the oblique insertion of the mating male terminal fitting.

A side wall extension portion 11 which extends straightly from the side wall 7 is formed continuously with a rear end 10 of the side wall 7. Further, a continuous slanting side wall portion 12 which is bent in the direction of the terminal central axis from the side wall extension portion 11 is formed in the side wall extension portion 11 (the term "bent" includes a meaning of "an S-shaped curve"). A board connecting portion 13 to be formed continuously with a circuit board is formed continuously with the slanting side wall portion 12.

The board connecting portion 13 is arranged so as to be located behind the bottom plate 2 and be located slightly nearer the side wall 7 than the terminal central axis. Further, board connecting portion 13 is arranged so as to become parallel to the terminal central axis. The side wall extension portion 11, the slanting side wall portion 12, and the board connecting portion 13 are belt-like, and are formed so as to have surfaces in the direction orthogonal to the bottom plate 2. The side wall extension portion 11 and the slanting side wall portion 12 are formed as a connecting portion 14 for connecting the board connecting portion 13.

Between the side wall extension portion 11 extending from the rear end 10 of the side wall 7 and the board connecting portion 13, the slanting side wall portion 12 is continued by bending. Therefore, the board connecting portion is formed so as to be capable of being deflected even in the front-back direction as well as in the right-left direction. Such a portion which can be deflected in the right-left direction and in the front-back direction, i.e., the connecting portion 14 is formed so as to function as a second relaxation structural portion 15 corresponding to oblique insertion of the mating male terminal fitting.

The female terminal fitting 1 for a board of the invention having the above structure is adapted to be able to resiliently deform in the up-down direction by the second stress relaxation portion 15 as shown in FIGS. 3A and 3B when there is oblique insertion of the mating male terminal fitting and thereby to absorb the force exerted by oblique insertion (In addition, the centerline in the drawing is a line about a fixed position of the board connecting portion 13, and is not the terminal central axis. Refer to the centerline of FIG. 2 about the terminal central axis.).

Further, the female terminal fitting 1 for a board of the invention, as shown in FIGS. 3C and 3D, is adapted to be able to resiliently deform in the right-left direction by the first stress relaxation portion 9 and thereby to absorb the force exerted by oblique insertion. Although particularly not shown, the female terminal fitting 1 for a board of the invention is also adapted to be able to resiliently deform in the front-back direction by the second stress relaxation portion 15 and thereby to absorb the force exerted by oblique insertion.

According to the female terminal fitting 1 for a board of the invention, the effect that contact stability can be sufficiently enhanced is exhibited.

In addition to this, the back of the female terminal fitting 1 having the above structure, as shown in FIG. 4, can be seen from a gap 16 formed between an inner surface of the female electrical contact portion 3 and the spring portion 4. Accordingly, since a portion which shields light does not exist light at the back of the female electrical contact portion 3, the dimensional control by image processing can be carried out (the effect that high-precision dimensional control over a contacting portion which the mating male terminal fitting contacts is exhibited).

Figure 5:
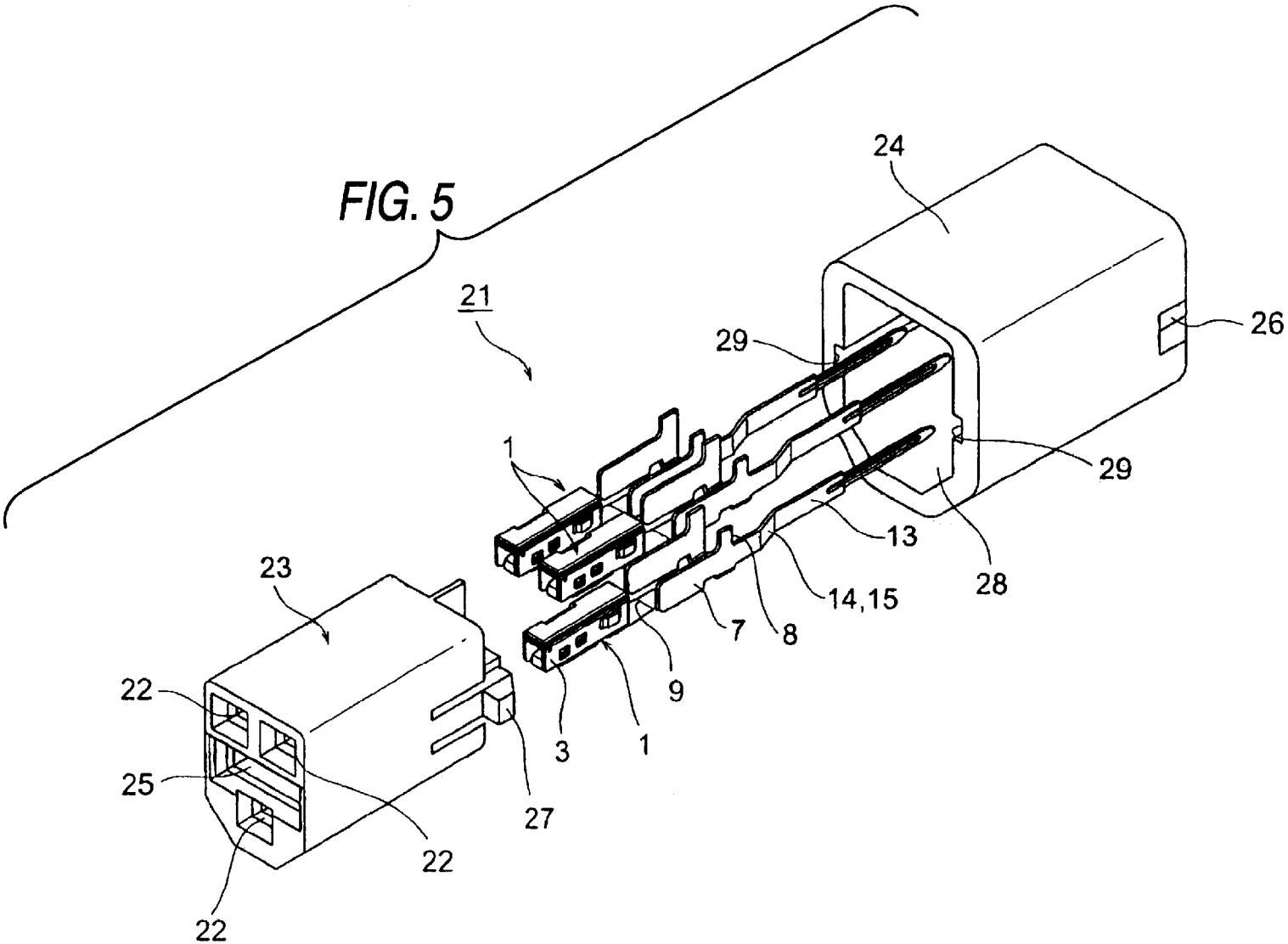
FIG. 5 is an exploded perspective view showing one embodiment of a connector for a board of the invention.
Figure 6:
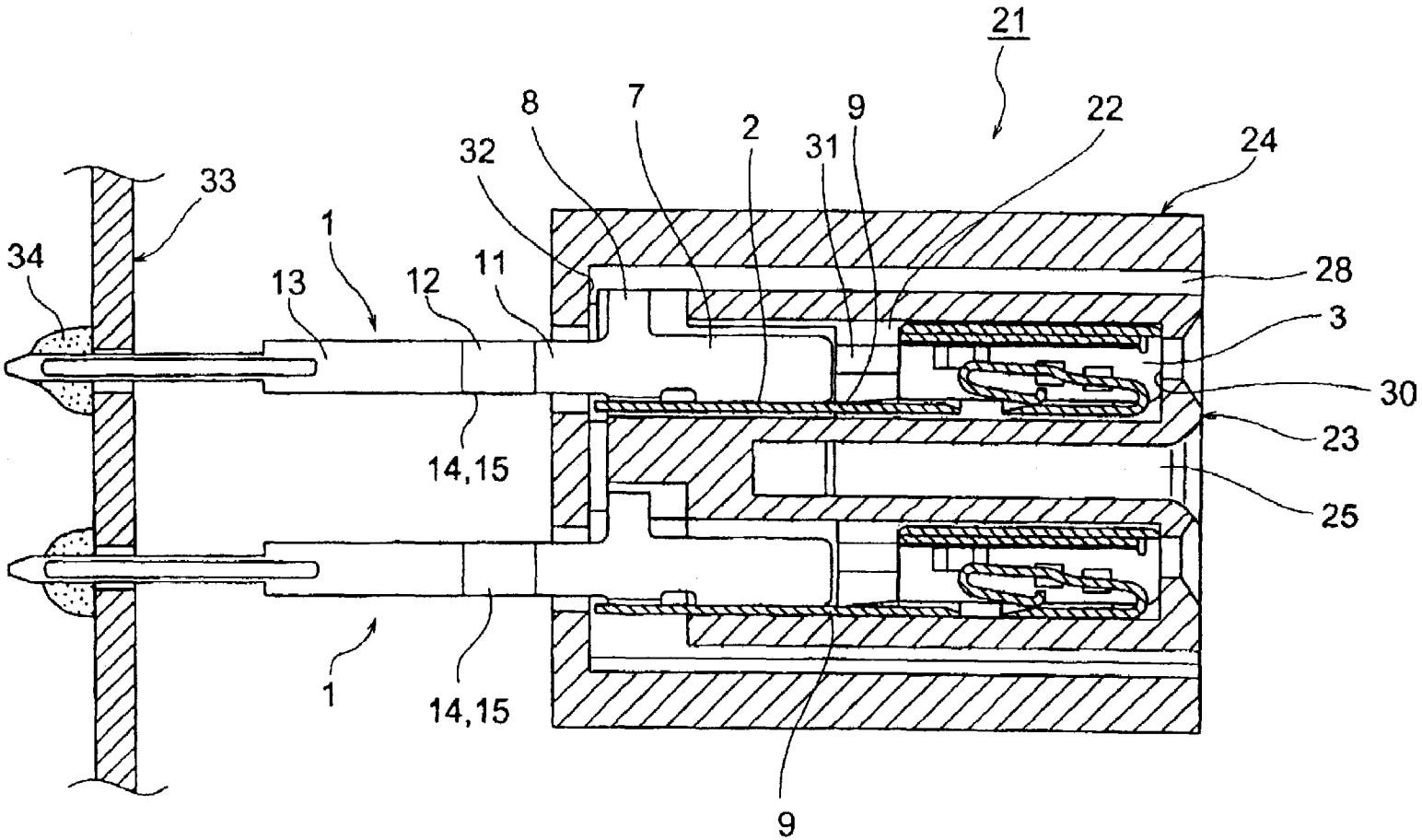
FIG. 6 is a sectional view of the connector for a board.
Figure 7A:
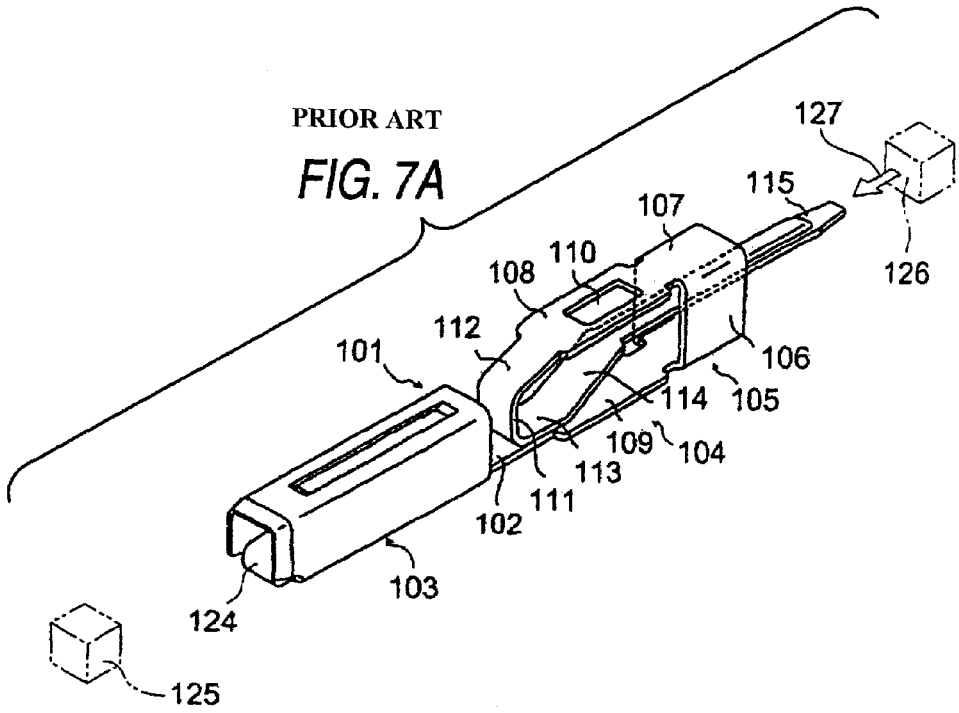
PRIOR ART FIG. 7A
FIG. 7A is a perspective view of a conventional female terminal fitting for a board.
Figure 7B:
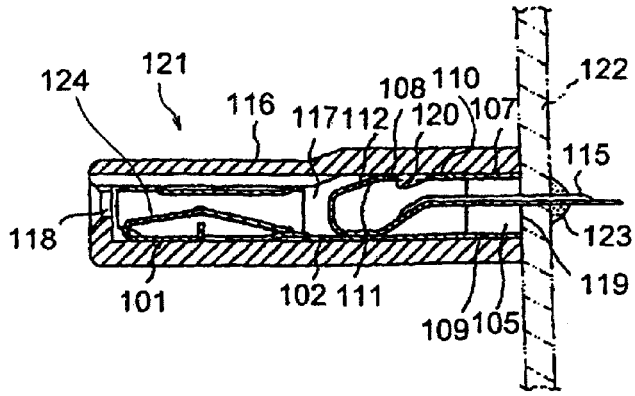
PRIOR ART FIG. 7B
FIG. 7B is a sectional view of a conventional connector for a board.

Next, a connector for a board including the female terminal fitting 1 for the board of the invention will be described with reference to FIG. 5 and FIG. 6. FIG. 5 is an exploded perspective view showing one embodiment of the connector for a board, and FIG. 6 is a sectional view of the connector for a board.

In FIG. 5, a connector 21 for a board includes the female terminal fitting 1, a housing 23, made of synthetic resin, having a terminal receiving chamber 22 which receives the female terminal fitting 1 for a board, and a cover housing 24, made of synthetic resin, which receives and fits to and locks the housing 23.

Other than the terminal receiving chamber 22, a guide hole 25 into which a guide projection of a mating connector (not shown) and a flexible lock 27 which is fitted and locked to a lock hole 26 of the cover housing 24 are formed in the housing 23. Three terminal receiving chambers 22 are formed in this embodiment. Between these chambers, the guide hole 25 is formed.

The cover housing 24 has a fitting and receiving portion 28 for the housing 23. A guide groove 29 for guiding a flexible lock 27 of the housing 23 to the lock hole 26 is formed in the fitting and receiving portion 28.

In FIG. 6, a first abutting portion 30 which is made to abut on a front face of the female electrical contact portion 3 of the female terminal fitting 1 for a board abut thereon to regulate its forward movement, and terminal fitting guide grooves 31 for guiding the guide projections 5 of the female electrical contact portion 3 are formed in the terminal receiving chamber 22. Further, a second abutting portion 32 which is made to abut on the abutting convex portion 8 of the female terminal fitting 1 for a board to regulate its back forward movement is formed in the cover housing 24. The first abutting portion 30 is formed at a front wall of the housing 23, and the second abutting portion 32 is formed at a rear wall of the cover housing 24.

When the connector 21 for a board is fixed by inserting the board connecting portion 13 protruding backward of the cover housing 24 into a circuit board 33 and by performing soldering 34, the connector for a board can then make fitting and connection with the mating connector.

In addition, the features of the connector 21 for a board are summarized as follows. That is, the connector for the board includes:

a female terminal fitting 1;

a housing 23 having a terminal receiving chamber 22 which receives the female terminal fitting 1; and a cover housing 24 which receives, and fits to and lock the housing 23, wherein a first abutting portion 30 abuts the female terminal fitting 1 against the terminal receiving chamber 22 to regulate a forward movement of the female terminal fitting 1;

wherein a second abutting portion 32 abuts the female terminal fitting 1 against the cover housing 24 to regulate a back forward movement of the female terminal fitting 1; and wherein the female terminal fitting 1 is held only by the abutment of the first abutting portion 30 and the second abutting portion 32.

According to the connector 21 for a board having such features, a connector in which the contact stability between the contacting portion of the female terminal fitting 1 for a board, and the mating male terminal fitting is improved is obtained. Further, according to the connector 21 for a board, a structure in which holding of the female terminal fitting 1 for a board is performed by making the female terminal fitting for a board abut on the first abutting portion 30 of the housing 23 and the second abutting portion 32 of the cover housing 24 is provided. Therefore, the die structure for the portion of the terminal receiving chamber 22 can be simplified.

It is natural that the invention can be changed in various ways without departing the scope or spirit of the invention.

The present application is based on Japan Patent Application No. 2007-314247 filed on Dec. 5, 2007, the contents of which are incorporated herein for reference.

What is claimed is:

1. A female terminal fitting, comprising:

a bottom plate formed in a flat shape and which extends in a front-back direction and a right-left direction;

a female electrical contact portion formed on a front side of the bottom plate for contacting a mating male terminal fitting; and a board connecting portion extending from the back of the bottom plate for connecting to a circuit board;

wherein the bottom plate has a first stress relaxation portion formed between the electrical contact portion and the board connecting portion, wherein the first stress relaxation portion is resiliently deformable in an up-down direction, said up-down direction being perpendicular to the front-back direction and the right-left direction;

wherein a side wall is erected from and formed on at least one side portion of the bottom plate, wherein the side wall is substantially perpendicular to the bottom plate and extends along the front-back direction;

wherein a belt-like connecting portion is formed between the side wall and the board connecting portion; and wherein the belt-like connecting portion is a second stress relaxation portion which is resiliently deformable in the right-left direction and in the front-back direction.

2. The female terminal fitting according to claim 1, wherein the side wall has an abutting convex portion which regulates a backward movement of the female terminal fitting when the female terminal fitting is inserted into a housing.

3. The female terminal fitting according to claim 1, wherein the first stress relaxation portion is a part of the bottom plate which has no side wall at both side portions of the bottom plate.

4. The female terminal fitting according to claim 1, wherein the bottom plate forms a central axis that extends along the front-back direction and lies in the center of the bottom plate; and wherein a back end of the belt-like connecting portion adjacent to the board connecting portion is closer to the central axis of the bottom plate than a front end of the belt-like connecting portion adjacent to the rear end of the side wall.

5. The female terminal fitting according to claim 1, wherein the belt-like connecting portion forms an obtuse angle with respect to the side wall.

6. The female terminal fitting according to claim 1, wherein the second stress relaxation portion is substantially perpendicular to the bottom plate and is not resiliently deformable in the up-down direction.

* * * * *